US005113944A

United States Patent [19]

Nakagawa et al.

[11] Patent Number: 5,113,944

[45] Date of Patent: May 19, 1992

[54] SIMPLE FIRE EXTINGUISHING APPARATUS

[75] Inventors: Seiichi Nakagawa; Yoshiharu Muruyama; Masanori Shiota, all of Osaka; Kando Ishida, Nara; Masayoshi Fujita, Nara; Shigenobu Yamada, Nara, all of Japan

[73] Assignee: Morita Pump Kabushiki Kaisha, Osaka, Japan

[21] Appl. No.: 631,862

[22] Filed: Dec. 21, 1990

[51] Int. Cl.[5] ..... A62C 35/58; A62C 35/68; A62C 35/00

[52] U.S. Cl. ..... 169/13; 169/16

[58] Field of Search ..... 169/13, 5, 60, 61, 56, 169/16

[56] References Cited

U.S. PATENT DOCUMENTS

| | | | |
|---|---|---|---|
| 3,179,181 | 4/1965 | Banzato | 169/13 |
| 4,140,146 | 2/1979 | Slanker | 169/13 X |
| 4,183,721 | 1/1980 | Peterson | 169/13 X |
| 4,330,040 | 5/1982 | Ence et al. | 169/13 |
| 4,366,865 | 1/1983 | Makibbin | 169/13 |
| 4,428,434 | 1/1984 | Gelaude | 169/13 |
| 4,991,657 | 2/1991 | LeLande, Jr. | 169/13 |

FOREIGN PATENT DOCUMENTS

| | | | |
|---|---|---|---|
| 2731057 | 1/1979 | Fed. Rep. of Germany | 169/13 |
| 2603194 | 3/1988 | France | 169/13 |
| 2-42652 | 3/1990 | Japan . | |
| 874474 | 11/1981 | U.S.S.R. | 169/13 |
| 1414682 | 11/1975 | United Kingdom | 169/13 |

*Primary Examiner*—Margaret A. Focarino
*Assistant Examiner*—James M. Kannofsky
*Attorney, Agent, or Firm*—Wegner, Cantor, Mueller & Player

[57] ABSTRACT

There is provided a simple fire extinguishing apparatus comprising a fire sensor 2 and a fire extinguishing water spraying head 3 positioned at required positions, a water tank 1 serving as a water supply source, a level switch 13 and a resupply port 10 which is not in contact with the water surface, installed in the water tank 1, a driving pump 7, a main pipe 5 allowing the suction and delivery sides of the driving pump 7 respectively to communicate with the water tank 1 and the fire extinguishing water spraying head 3, a control valve 8 installed in the main pipe 5 and adapted to be actuated by the fire sensor 2 and the level switch 13, a resupply pipe 4 branching from a tap water pipe 11 and extending to communicate with the resupply port 10, and a control valve 9 installed in the resupply pipe 4 and adapted to be actuated by the fire sensor 2 and the level switch 13, the arrangement being such that when a fire breaks out, water is fed from the water tank 1 through the main pipe 5 to the fire extinguishing water spraying head 3 and concurrently therewith water is resupplied from the tap water pipe 11 through the resupply pipe 4 and the resupply port 10 to the water tank 1.

1 Claim, 4 Drawing Sheets

SIMPLE FIRE EXTINGUISHING APPARATUS

BACKGROUND OF THE INVENTION

The present invention relates to a simple fire extinguishing apparatus and particularly it relates to a fire extinguishing apparatus designed so that when a fire breaks out, using a water tank for appreciation or other purposes as a water supply source, it sprays water from a fire extinguishing water spraying head.

Recently, with the advent of an aging society, earlier fire control is called for to provide a sufficient period of time for persons of advanced age to escape. In high-rise buildings and other large-scale buildings, the installation of automatic fire extinguishing apparatuses, such as sprinklers, is compulsory. In contrast, a fire fighting or extingushing system for ordinary dwelling houses has not been legally prescribed and is late in being put into practical use. Although fire extinguishers have been installed, they have not reached the stage of automatic fire extinguishment upon occurrence of a fire.

When it is desired to install an automatic fire extinguishing apparatus, such as a sprinkler for buildings, in an ordinary home, such factors as place of installation and cost become problems: such system can hardly spread to families in general, particularly families of old people. As a simmple inexpensive method, a household tap water pipe may be utilized and extended to the ceiling of the house, with a solenoid valve employed to control the delivery of water from the pipe. If a fire sensor is installed in a house and senses a fire, the solenoid valve will be opened to spray water from the ceiling. However, such fire extinguishing apparatus is still in the planning stage. In the case where a tap water pipe is used as a fire extinguishing water spraying head, propagation of bacteria occurs in the tap water pipe if the latter is left unused; thus, there is a sanitation problem of bacteria migrating into the drinking water.

The polluted water is so-called "dead water", not accepted by the Tap Water Law. The present invention has been accomplished with the above in mind and has for its object the provision of a simple fire extinguishing apparatus for general household use, designed to operate upon occurrence of a fire for automatic fire extinguishment by utilizing as a water source for fire extinguishment a tropical fish or water plant rearing water tank usually installed as an interior decoration in a room and spraying water by a fire extinguishing water spraying head using a pump drawing a pressurizing water.

SUMMARY OF THE INVENTION

According to the present invention, there is provided a simple fire extinguishing apparatus comprising a fire sensor and a fire extinguishing water spraying head positioned at required positions, a water tank serving as a water supply source, a level switch and a resupply port which is not in contact with the water surface, installed in the water tank, a driving pump, a main pipe allowing the suction and delivery sides of the driving pump respectively to communicate with the water tank and the fire extinguishing water spraying head, a control valve installed in the main pipe and adapted to be actuated by the fire sensor and the level switch, a resupply pipe branching from a tap water pipe and extending to communicate with the resupply port, and a control valve installed in the resupply pipe and adapted to be actuated by the fire sensor and the level switch, the arrangement being such that when a fire breaks out, water is fed from the water tank through the main pipe to the fire extinguishing water spraying head and concurrently therewith water is resupplied from the tap water pipe through the resupply pipe and the resupply port to the water tank.

When a fire occurs, the fire sensor is actuated to rotate the driving pump, drawing water from the water tank and pressurizing the water and the fire extinguishing water spraying head sprays the water. However, if the water stored in the water tank alone is used, it will be exhausted in a short time; therefore, concurrently with the rotation of the driving pump, the control valve in the resupply pipe is opened to add water from the resupply port in proportion to the amount of water sprayed to maintain the water level at a constant value.

As has so far been described, according to the present invention, in a environment where water tanks for appreciation purposes are being used as interior decorations for pleasure by men of today having little opportunity to come in contact with nature and by old people who are increasing in number with the advent of an aging society, these water tanks are utilized to provide stabilized amounts of water for sprinklers for early fire extinguishment in case of a fire. Further, since these water tanks serve as interior decorations, the cost of construction work is low; it is only necessary to lay the pipes for the fire extinguishing water spraying heads and the resupply pipe branching from the tap water pipe. The arrangement is simple, requiring simple maintenance and inspection. In Japan, direct piping to the tap water pipe is inhibited by law, and there have been problems including one of "dead water". In the present invention, since the tap water pipe is connected to the resupply pipe and the resupply port is not in contact with the water surface, there is no danger of forming "dead water" specified in the Tap Water Law.

Thus, there has been provided a simple inexpensive fire extinguishing apparatus for dwelling houses in general which does not conflict the Tap Water Law and which is easy to construct.

DETAILED DESCRIPTION OF THE PREFERRED EMBODIMENTS

An embodiment of the invention will now be described in detail with reference to the drawings.

Figure 1:
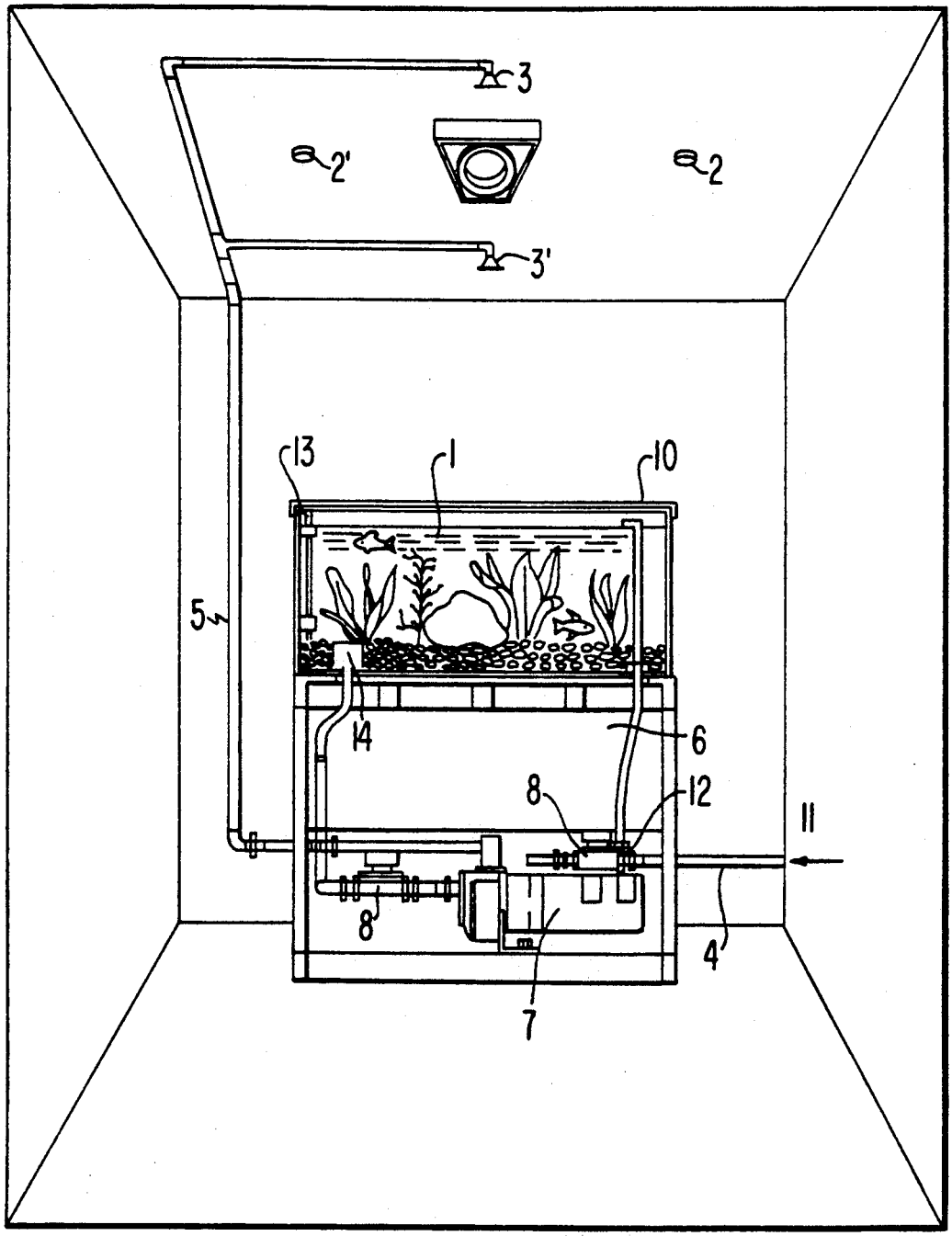
FIG. 1 is a developed view of a room having installed therein a simple fire extinguishing apparatus according to the invention.

FIG. 1 is a developed view of a room provided with a simple fire extinguishing apparatus according to the invention.

Figure 2:
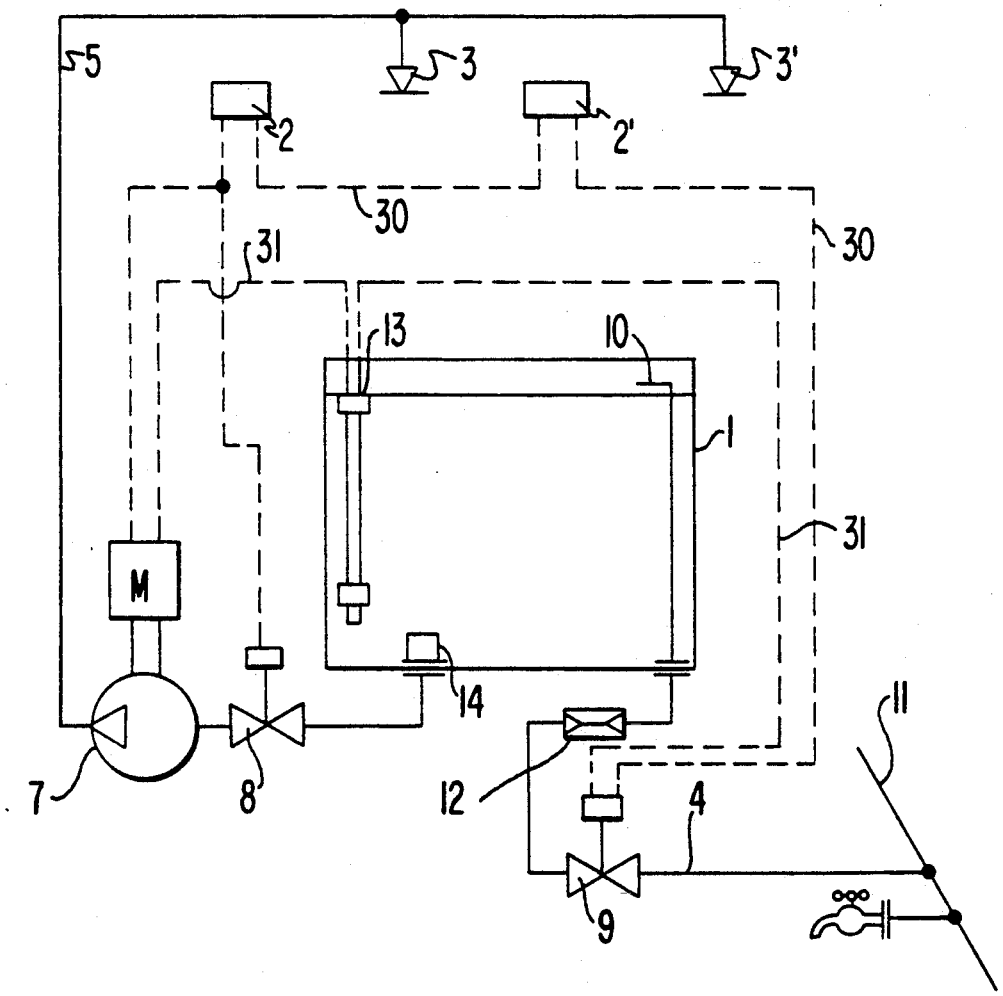
FIG. 2 is a system diagram showing an embodiment of the invention, said embodiment being of one-room type.

FIG. 2 is a system diagram of an embodiment.

The numeral 1 denotes a water tank which may be a decorative article installed in a room for rearing fishes or plants for appreciation purposes, and a filter pump (not shown) is attached to the upper region of said water tank 1 for filtering the water in the water tank 1 to keep the water clear. a predetermined amount of water being held therein, said water tank 1 being placed on an exclusive stand 6.

A resupply pipe 4 branches from a tap water pipe 11 to lie above the water level in the water tank 1 and extending to a resupply port 10 disposed out of contact with the water surface, said resupply pipe 4 being provided with a throttle valve 12 and a control valve 9. A main pipe 5 has a driving pump 7 which is mounted on the exclusive stand 6 and whose delivery side is connected to fire extinguishing water spraying heads 3 and 3' attached to the ceiling and whose suction side extends from the water tank 1 through a strainer 14 and a control valve 8. The water tank 1 is provided with a level switch 13 for detecting the upper and lower limmits of the amount of water. The ceiling of the room is provided with two fire sensors 2 and 2' differing in sensing system from each other for sensing a fire.

If a fire breaks out, the fire sensors 2 and 2' installed on the ceiling sense the fire, sending a sensor signal 30 to the motor of the driving pump 7 of the main pipe 5 and to the control valve 8, so that the driving pump 7 is rotated and the control valve 8 is opened to feed water to the driving pump 7 and the water is pressurized. Concurrently therewith, the control valve 9 in the resupply pipe 4 is opened to resupply water from the resupply port 10, while the fire extinguishing water spraying heads 3 and 3' fixed to the ceiling spray water to extinguish the fire. If the water level lowers to the lower limit owing to too much water being fed by the driving pump 7 or too little water being resupplied, the level switch 13 attached to the water tank 1 senses it and sends a level signal 31 to stop the driving pump 7, while if the water level reaches the upper limit owing to too much water being resupplied, it sends a level signal 31 to close the control valve 9 of the resupply pipe 4 to stop the resupply, thereby maintaining the water level in the water tank 1 at a constant position.

In this case, it is difficult to maintain such constant water level while resupplying water in proportion to the amount of water being sprayed since the rate of delivery of water from the tap water pipe 11 differs from home to home; therefore, a throttle valve 12 is placed in the resupply pipe 4 to control the flow rate.

Figure 3:
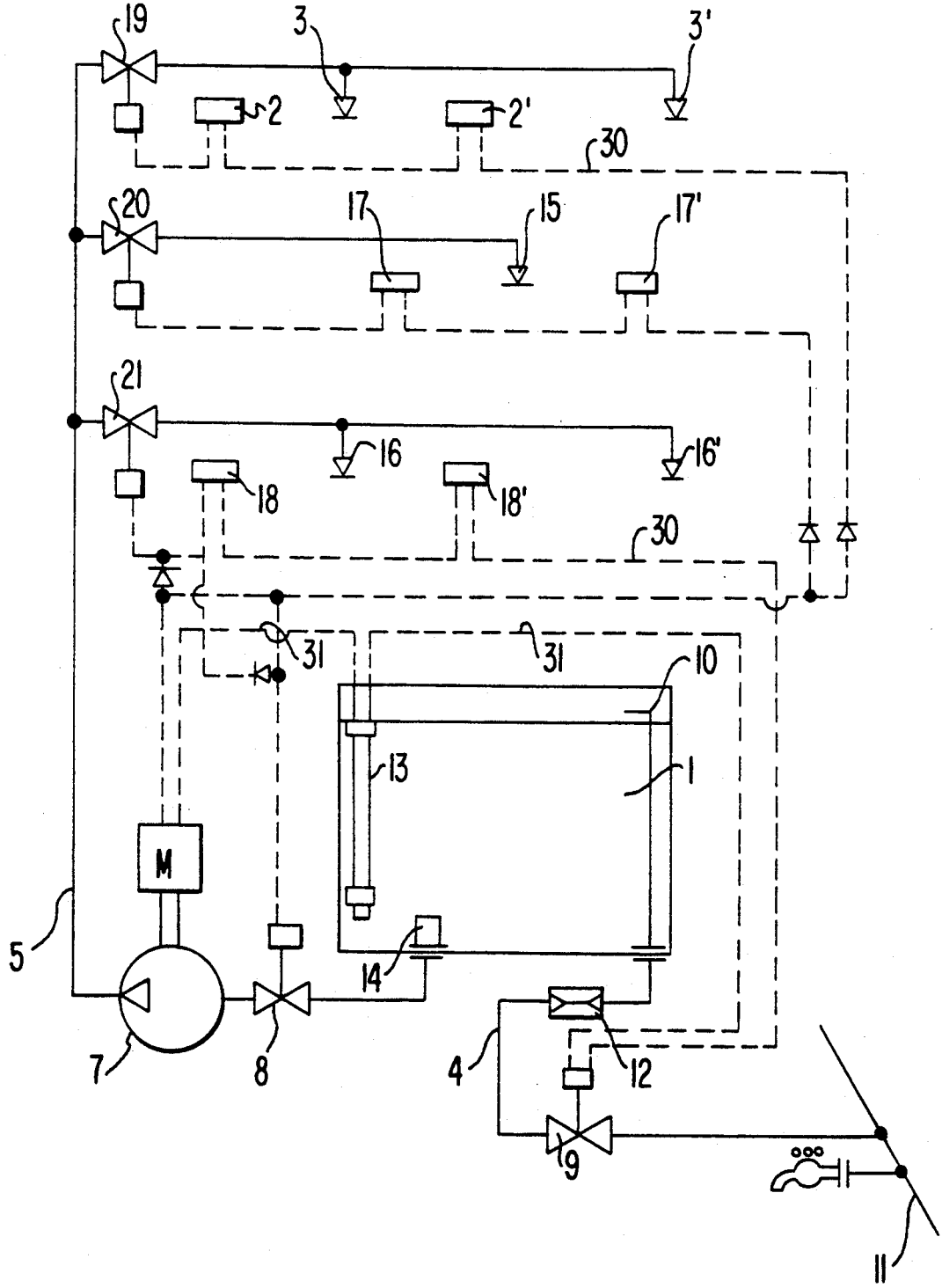
FIG. 3 is a system diagram showing an embodiment of the invention, said embodiment being of multi-room type.

FIG. 3 shows another embodiment.

A resupply pipe 4 branches from a tap water pipe 11 to lie above the water level in the water tank 1 for appreciation purposes and extending to a resupply port 10 disposed out of contact with the water surface, said resupply pipe 4 being provided with a throttle valve 12 and a control valve 9. A main pipe 5 has a driving pump 7 which is mounted on an exclusive stand 6 and whose delivery side is connected to fire extinguishing water spraying heads 3, 3', 15, 16 and 16' fixed to the ceilings of rooms through control valves 19, 20 and 21 and whose suction side extends from the water tank 1 through a strainer 14 and a control valve 8. Further, the ceilings of these rooms are provided each with fire sensors 2, 2', 17, 17', 18, 18' differing in sensing system from each other for sensing a fire.

The water tank 1 is provided with a level switch 13 for detecting the upper and lower limits of the amount of water.

If a fire breaks out, those of the fire sensors 2, 2', 17, 17', 18, 18' installed on the ceiling disposed in the room in which the fire started sense the fire, sending a sensor signal 30 to the control valves 19, 20 and 21 of the associated pipe, the motor of the driving pump 7 of the main pipe 5 and the control valve 8, so that the driving pump 7 is rotated and the control valve 8 is opened to feed water to the driving pump 7 and the water is pressurized. Concurrently therewith, the control valve 9 in the resupply pipe 4 is opened to resupply water from the resupply port 10, while the fire extinguishing water spraying heads 3, 3', 15, 16 and 16' fixed to the ceiling spray water to extinguish thefire.

If the water level lowers to the lower limit owing to too much water being fed by the driving pump 7 or too little water being resupplied, the level switch 13 attached to the water tank 1 senses it and sends a level signal 31 to stop the driving pump 7, while if the water level reaches the upper limit owing to too much water being resupplied, it sends a level signal 31 to close the control valve 9 of the resupply pipe 4 to stop the resupply, thereby maintaining the water level in the water tank 1 at a constant position.

Figure 4:
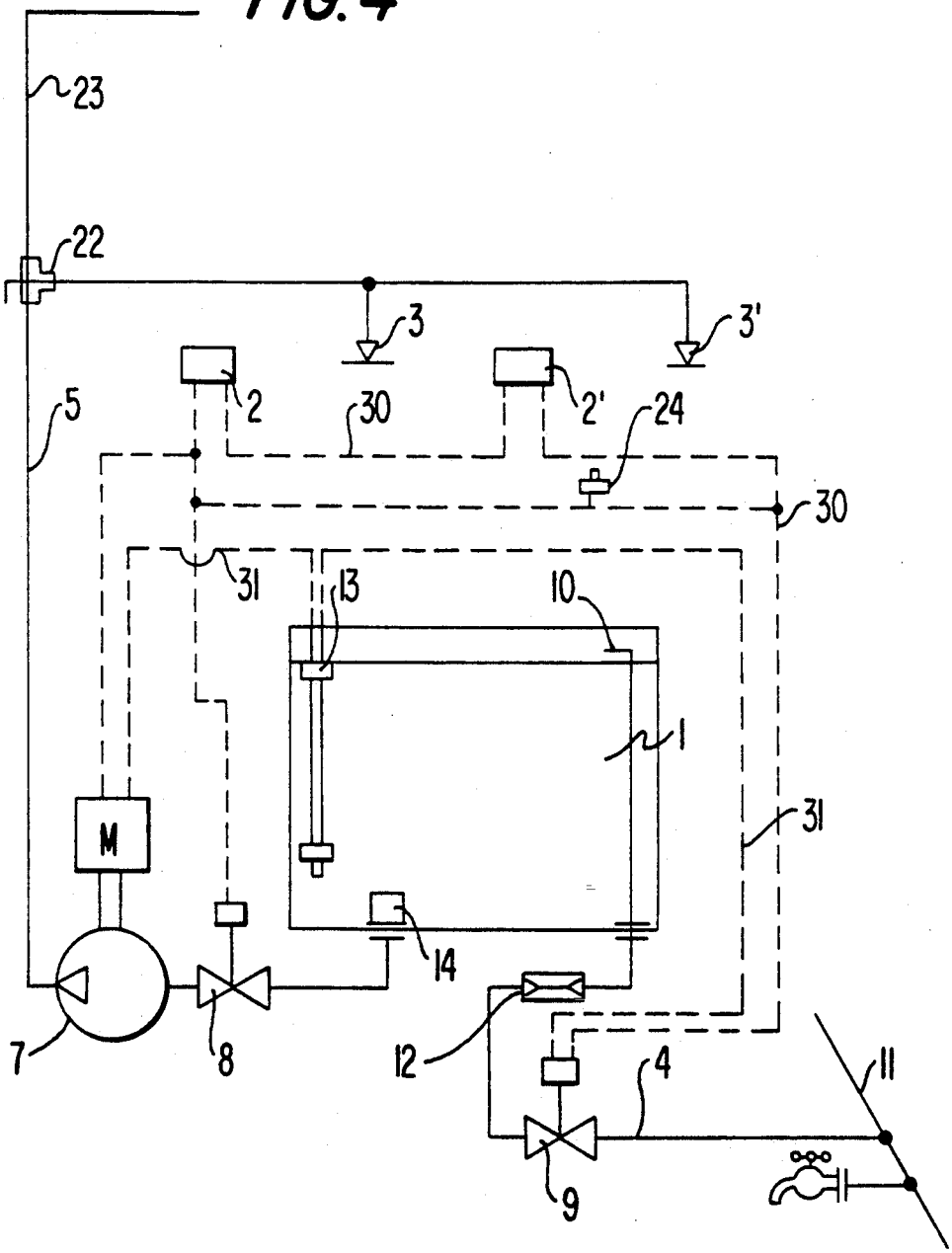
FIG. 4 is a system diagram showing another embodiment of the invention, said embodiment being adapted to serve both as a fire extinguishing apparatus and as a water tank cleaner.

FIG. 4 shows a system diagram of another embodiment.

A resupply pipe 4 branches from a tap water pipe 11 to lie above the water level in the water tank 1 for appreciation purposes and extending to a resupply port 10 disposed out of contact with the water surface, said resupply pipe 4 being provided with a throttle valve 12 and a control valve 9. A main pipe 5 has a driving pump 7 which is mounted on an exclusive stand 6 and whose delivery side is connected through a three-way cock 22 to fire extinguishing water spraying heads 3 and 3' attached to the ceiling and a drain pipe 23 disposed outdoors, the pipe associated with the fire extinguishing water spraying heads 3 and 3' being normally opened and the drain pipe 23 being closed. The suction side of the driving pump 7 extends from the water tank 1 through a strainer 14 and a control valve 8. The water tank 1 is provided with a level switch 13 for detecting the upper and lower limits of the amount of water. The ceiling of the room is provided with two fire sensors 2 and 2' differing in sensing system from each other for sensing a fire.

If a fire breaks out, the fire sensors 2 and 2' installed on the ceiling sense the fire, sending a sensor signal 30 to the motor of the driving pummp 7 in the main pipe 5 and to the control valve 8, so that the driving pump 7 is rotated and the control valve 8 is opened to feed water to the driving pump 7 and the water is pressurized. Concurrently therewith, the control valve 9 in the resupply pipe 4 is opened to resupply water from the resupply port 10, while the fire extinguishing water spraying heads 3 and 3' fixed to the ceiling spray water to extinguish the fire.

If the water level lowers to the lower limit owing to too much water being fed by the driving pump 7 or too little water being resupplied, the level switch 13 attached to the water tank 1 senses it and sends a level signal 31 to stop the driving pump 7, while if the water level reaches the upper limit owing to too much water being resupplied, it sends a level signal 31 to close the control valve 9 of the resupply pipe 4 to stop the resupply, thereby maintaining the water level in the water tank 1 at a constant position.

When tropical fishes or the lile are to be reared, it is necessary to replace ⅓ of water in the water tank 1 with fresh water once every 10 days by using a cleaner pump to draw water through a siphon and to add fresh water. It is also necessary to clean the water tank 1 once every 6 months or so, when said cleaner pump must be used to draw all of the water through the siphon, thus requiring much labor and time. However, for such cleaning of the water tank 1 and change of water, it is only necessary to switch the three-way cock 22 to the pipe 23 to operate the motor of the driving pump 7 and push a manual switch 24 for operating the control valve 9 of the resupply 4. The invention is not limited to the embodiment: as the water tank 1, use may be made of a water receiving tank, a plastic tank or a flush water tank.

As many apparently widely different embodiments of this invention may be made without departing from the spirits and scope thereof, it is to be understood that the invention is not limited to the specific embodiments thereof except as defined in the appended claims.

What is claimed is:

1. A simple fire extinguishing apparatus comprising:

a fire sensor and a fire extinguishing water spraying head positioned at required positions, a water supply source comprising a water tank, a level switch for detecting a maximum water level in the water tank and a resupply port installed in the water tank, wherein the resupply port is disposed at a level above the maximum water level in the water tank, a driving pump having a suction side and a delivery side, a main pipe allowing the suction side of the driving pump to communicate with the water tank and the delivery side to communicate through a three-way cock with the fire extinguishing water spraying head and a drain pipe, a control valve installed in the main pipe and adapted to be actuated by the fire sensor and the level switch, a resupply pipe branching from a tap water pipe and extending to communicate with the resupply port, and a control valve installed in the resupply pipe and adapted to be actuated by the fire sensor and the level switch, whereby when a fire breaks out, water is fed from the water tank through the main pipe to the fire extinguishing water spraying head and concurrently therewith water is resupplied from the tap water pipe through the resupply pipe and the resupply port to the water tank.

* * * * *